US011377276B2

(12) United States Patent
Mueller et al.

(10) Patent No.: US 11,377,276 B2
(45) Date of Patent: Jul. 5, 2022

(54) DRYING CONTAINER

(71) Applicant: BACHEM HOLDING AG, Bubendorf (CH)

(72) Inventors: Andreas Mueller, Reigolswil (CH); Christoph Erdin, Rheinfelden (CH)

(73) Assignee: BACHEM HOLDING AG, Bubendorf (CH)

( * ) Notice: Subject to any disclaimer, the term of this patent is extended or adjusted under 35 U.S.C. 154(b) by 753 days.

(21) Appl. No.: 16/321,051

(22) PCT Filed: Jul. 6, 2017

(86) PCT No.: PCT/EP2017/066964

§ 371 (c)(1),
(2) Date: Jan. 28, 2019

(87) PCT Pub. No.: WO2017/137637

PCT Pub. Date: Aug. 17, 2017

(65) Prior Publication Data

US 2021/0316918 A1 Oct. 14, 2021

(30) Foreign Application Priority Data

Aug. 5, 2016 (EP) ..... 16182931

(51) Int. Cl.
*B65D 51/24* (2006.01)
*B65D 45/16* (2006.01)

(52) U.S. Cl.
CPC ..... *B65D 51/241* (2013.01); *B65D 45/16* (2013.01)

(58) Field of Classification Search
CPC ..... B65D 21/241; B65D 15/16; F26B 5/06
USPC ..... 34/92, 284
See application file for complete search history.

(56) References Cited

U.S. PATENT DOCUMENTS 2,732,092 A 1/1956 Lawrence
3,811,199 A * 5/1974 Bouldoires ..... F26B 5/06 34/92
4,173,078 A * 11/1979 Bird ..... F26B 5/06 34/92
4,512,498 A 4/1985 Leibinger
4,551,311 A 11/1985 Lorenz
(Continued)

FOREIGN PATENT DOCUMENTS

CN 105806080 A 7/2016
DE 2301144 A1 8/1974
(Continued)

OTHER PUBLICATIONS

Machine translation of JP H05-039825.

*Primary Examiner* — Stephen M Gravini
(74) *Attorney, Agent, or Firm* — J.A. Lindeman & Co. PLLC

(57) ABSTRACT

The invention relates to containers for the drying, especially the freeze-drying, of material. In particular, the invention relates to a lid of a drying container, said lid enabling to close the container body of the drying container so as to avoid i) contamination of the material to be dried inside the container and ii) spills of airborne solid particles of said material from the container to the environment. The lid comprises a lower and an upper frame with a vapor permeable sheet positioned in between. The invention further provides methods for the drying, especially the freeze-drying, of material.

16 Claims, 14 Drawing Sheets

(56) References Cited

U.S. PATENT DOCUMENTS

| | | | | | |
|---|---|---|---|---|---|
| 4,973,327 | A * | 11/1990 | Goodrich, Jr. | F26B 5/06 | 604/408 |
| 5,199,186 | A * | 4/1993 | Rice | F26B 5/045 | 34/143 |
| 5,309,649 | A * | 5/1994 | Bergmann | F26B 5/06 | 34/201 |
| 5,937,536 | A * | 8/1999 | Kieselbach | F26B 21/004 | 34/92 |
| D425,205 | S | 5/2000 | Henigan et al. | | |
| D430,939 | S | 9/2000 | Zukor et al. | | |
| 6,517,526 | B1 * | 2/2003 | Tamari | A01N 1/0236 | 604/403 |
| 6,764,481 | B1 * | 7/2004 | Inada | A61J 1/1462 | 604/408 |
| 6,773,425 | B1 | 8/2004 | Tamari | | |
| 6,981,337 | B2 * | 1/2006 | Jones | B01D 53/261 | 34/80 |
| 7,776,022 | B2 * | 8/2010 | McCarthy | A61P 7/08 | 604/408 |
| 8,574,213 | B2 * | 11/2013 | Thilly | B65D 51/241 | 604/411 |
| 9,161,527 | B2 * | 10/2015 | Cutting | F17C 3/085 | |
| 9,278,790 | B2 | 3/2016 | McPherson et al. | | |
| 9,540,154 | B2 * | 1/2017 | Vrijens | A61J 1/1406 | |
| 9,561,893 | B2 * | 2/2017 | Root | A61J 1/1475 | |
| 9,863,699 | B2 * | 1/2018 | Corbin, III | A61J 1/1475 | |
| 9,879,908 | B2 * | 1/2018 | Triglia, Jr. | F26B 15/18 | |
| 10,793,327 | B2 * | 10/2020 | Weimer | B65D 51/241 | |
| 10,945,959 | B2 * | 3/2021 | Murto | F26B 5/06 | |
| 11,067,336 | B2 * | 7/2021 | Corbin, III | A61J 1/1475 | |
| 2003/0183540 | A1 | 10/2003 | Onishi | | |
| 2008/0256822 | A1 | 10/2008 | Suzuki et al. | | |
| 2021/0316918 | A1 * | 10/2021 | Mueller | F26B 5/06 | |

FOREIGN PATENT DOCUMENTS

| | | | | |
|---|---|---|---|---|
| DE | 3500026 | A1 | 7/1986 | |
| EP | 2157387 | A1 | 2/2010 | |
| EP | 3494349 | B1 * | 10/2020 | B65D 51/241 |
| GB | 2252712 | A | 8/1992 | |
| JP | S58-136349 | A | 8/1983 | |
| JP | H11-148774 | A | 6/1999 | |
| JP | 2007131343 | A | 5/2007 | |
| JP | 2010-522176 | A | 7/2010 | |
| JP | 2015230898 | A | 12/2015 | |
| WO | 2008/115548 | A2 | 9/2008 | |
| WO | WO-2017137637 | A3 * | 10/2017 | F26B 5/06 |

* cited by examiner (e)

(f)

(g)

(h)

(i)

(ii)

(iii)

(a)

(b)

(a)

(b)

(c)

(a)

(b)

(c)

(d)

(a)

(b)

(a)

(b)

(c)

(d)

(e)

(f)

(a)

(b)

(a)

(b)

(a)

(b)

DRYING CONTAINER

The present invention generally relates to containers for the drying of material. In particular, the invention relates to a lid of a drying container, said lid enabling to close the container body of the drying container so as to avoid i) contamination of the material to be dried inside the container and ii) solid and optionally liquid spills of said material from the container to the environment. The invention further provides drying containers comprising a container body and said lid, and methods for the drying of material. The containers and methods of the present invention are in particular suitable for freeze-drying of bulk material, such as biological material or pharmaceutical products.

Drying is a common step in many industrial processes, e.g. in the food, chemical, and pharmaceutical industry. The drying of bulk material such as slurries, suspensions, or liquid solutions is commonly carried out in open containers, e.g. in flat open trays. These are placed in a drying chamber, where evaporation of liquid occurs under appropriate conditions, usually at controlled pressure and temperature. The use of such open containers is however disadvantageous in that it bears the double risk of contaminating the material to be dried and of causing liquid or solid spills of said material to the surroundings. Hence, depending on the properties of the material to be dried, it is necessary to work in a clean room to avoid contamination of the dried product, and/or to perform extensive cleaning of the drying chamber. If the material is hazardous, as is the case for many active pharmaceutical ingredients, containment of the material in its wet or liquid state before drying as well as in its final dried state is essential for occupational safety. The containment of the dried product, which often forms fine powders or dust, is particularly challenging.

The above points apply in particular to methods of freeze drying or lyophilization. Freeze drying is widely used to improve the stability and handling of foods or pharmaceutical ingredients and compositions. The process comprises preparing and freezing the material to be dried followed by one or more drying steps. A primary drying step involves sublimation of the water/solvent at reduced pressure and temperature. A secondary drying step may involve gradual heating under low pressure conditions so as to remove residual water/solvent. To control the conditions the material is exposed to, it is preferable to precisely monitor temperature and pressure inside the lyophilization container. During lyophilization, evaporation of the solvent at reduced pressure and subsequent ventilation of the drying chamber may give rise to turbulences and cause spills of fine solid particles of the dried product.

The purpose of the present invention is to provide a flexible and resource-efficient container for the (freeze-) drying of material, which protects said material from contamination and, at the same time, enables containment of said material. Preferably, the container additionally allows to measure process parameters such as pressure and temperature in the immediate vicinity of the drying material during lyophilization.

Several closed or closable containers for bulk (freeze-) drying are known from the prior art.

U.S. Design Pat. Nos. D430,939 and D425,205 describe a lyophilization container marketed as Gore® Lyoguard®. It comprises a lyophilization tray with a flexible, thin-film bottom, rigid walls and a spout for filling positioned above the floor of the tray. The tray is topped with a hydrophobic membrane, which is fixed to the tray and cannot be removed without destroying the container.

U.S. Pat. No. 6,517,526 teaches a similar sealed lyophilization container comprising a tray with flexible floor, at least one fluid port, and a roof incorporating a hydrophobic membrane.

U.S. Pat. No. 5,309,649 describes a lyophilization tray made from a synthetic resin, which is tightly closed by an hydrophobic, porous, micro-organism impermeable, water vapor permeable membrane.

EP 2 157 387 describes a very similar container comprising a plastic tray, a water vapor permeable membrane, and an additional snap-on lid allowing to store the dried material inside the lyophilization tray.

Each of the above lyophilization containers is designed for single use and thus is resource intensive. Moreover, cutting the container open to recover the dry material bears the risk of introducing debris into the dried product. As the trays are made from synthetic resin, leachables and extractables may be an issue, depending on the solvents present in the material to be dried. There is a need for a more economic and flexible lyophilization container, allowing to select and independently combine the materials of the container body and the membrane. Moreover, there is a need to improve the unloading of closed lyophilization containers.

US 2008/0256822 discloses a container for freeze-drying and housing a freeze-dried article, comprising a container body and a cover removably attached to the container body. A nonporous moisture-permeable film is arranged on at least a portion of the cover. The document teaches the use of a O-ring or similar sealing member, but is otherwise silent on how to achieve a tight closure between the container body and the cover. Moreover, such elastic sealing elements are prone to wear and difficult to clean.

U.S. Pat. No. 9,278,790 discloses a lid assembly for covering and sealing a lyophilizer tray. The assembly comprises a first lid disposable to seal around the lip of the lyophilizer tray, a second lid positioned on top of the first lid, and a filter paper between both lids. The first lid comprises an opening covered by the filter paper and the second lid, wherein the second lid comprises holes positioned on top of the first lid's opening. Stoppers may be inserted into the holes to protect the contents of the tray from moisture after drying. The membrane area is small compared to the surface area of the tray, which hinders evaporation of solvent and results in high vapor pressure inside the container. This is undesirable because it may cause inhomogeneity of the resulting lyophilizate as well as leakage due to lifting of the lid, and brings about the need for slow lyophilization cycles to avoid product melt-back. The lid assembly seems to be simply put on top of the tray without any fastening means and keeps on the lyophilizer tray closed due to its weight.

There is a need for a robust, versatile and reusable lyophilization container with a large membrane area, which can be easily opened but provides a dust-tight seal in its closed state. Preferably, such a container should allow for the optimal choice and online monitoring of process parameters during drying, e.g. of pressure and temperature inside the container. Moreover, the container should preferably be adaptable to the requirements of good manufacturing practices (GMP). For use in a GMP setting, the container should not set free any leachables or extractables and allow for efficient cleaning of reusable parts. The drying container of the present invention addresses these needs.

DISCLOSURE OF THE INVENTION

A lid assembly for a drying container is proposed. The lid assembly comprises a lower frame F1, an upper frame F2, fastening means and a vapor permeable sheet, which is positioned between the two frames and forms a part of the lid's top wall. Preferably, the sheet is liquid impermeable. The lower frame F1 and the upper frame F2 are each shaped as an open box having a base area and at least one side wall. The lower frame F1 and the upper frame F2 are arranged such that a circumferential channel of preferably uniform width is formed, an outer side wall of the channel being formed by the side walls of the upper frame F2, an inner side wall of the channel being formed by the side walls of the lower frame F1, and a top wall of the channel being formed by a broad rim of the upper frame F2. The lower frame F1 and the upper frame F2 each comprise at least one opening in their respective base area, wherein the at least one opening in the lower frame F1 at least partially overlaps with the at least one opening in the upper frame F2. The sheet covers the at least one opening in the lower frame F1 and the sheet further covers at least a part of the top wall of the channel. Preferably, the sheet covers the complete top wall of the channel. The lower frame F1, the sheet, and the upper frame F2 are aligned and held together by the fastening means.

The upper and the lower frame cooperate with the sheet to affect a tight seal of the container when the lid-assembly is placed on a container body. The sheet, which covers at least a part of the top channel wall, provides a gasket like effect so that no additional seal has to be included. The channel of the lid assembly provides for a relatively broad contact surface with the side walls of the container body and may be fixed to it by reversible fastening means. It was found that the lid assembly of the present invention provides a tight seal and eliminates the need for any elastomeric sealing elements. The width of the channel is chosen such that a mouth of a container body can engage in the channel. Preferably, the width of the channel is chosen from 0.5 to 5 cm, more preferably from 0.5 to 2 cm.

Optionally, the lid assembly may include an additional circumferential flat seal which may be inserted between the sheet and the upper frame F2. Alternatively or additionally, a flat circumferential flat seal may be inserted between the sheet and the lower frame F1 and/or between the sheet and the mouth of the container body.

The open box-shape of the lower frame F1 and/or the upper frame F2 may be obtained by folding a flat plate. For example, a rectangular base area with adjacent flaps may be cut from a flat plate and the side walls are obtained by folding the flaps so that they are substantially at an angle of 90° with respect to the base area.

The open box-shape of the lower frame F1 and/or the upper frame F2 may preferably include gaps in the side walls, especially at the positions where two of the side walls meet. Such gaps may occur when the open box-shape is obtained by folding. The gaps are then between two adjacent flaps forming two of the side walls. Optionally, the gaps may be closed for example by welding. If the gaps are present, the frames F1 and F2 are more flexible and may better follow the shape of a buckled container body.

Alternatively, the open box-shape may for example be obtained by molding or deep-drawing. The height of the side walls of the open box-shape defines the depths of the channel. It is preferred that the height of the side walls of the lower frame F1 and/or the upper frame F2 are chosen in the range of from 0.5 to 3 cm.

The sheet is held between the lower frame F1 and the upper frame F2. The lower frame F1 and the upper frame F2 are held together by fastening means. In order for the sheet to be replaceable, it is preferred that the connection between the two frames is releasable. It is preferred to use fastening means to keep the lower frame F1, the sheet and the upper frame F2 aligned and firmly pressed together. Any type of screw, clamp, magnetic, or other fastening means may be used for this purpose.

Preferably, the fastening means comprise threaded rods attached to the lower frame F1, which extend through holes in the sheet and holes in the upper frame F2, and screw nuts screwed onto said threaded rods so as to press the upper frame F2 and the sheet onto the lower frame F1. In order to replace the sheet, the nuts are unscrewed from the threaded rods and the upper frame F2 is removed. The old sheet is removed and replaced with a fresh sheet. Afterwards, the upper frame F2 is placed back into the lower frame F1 and secured with the nuts screwed onto the threaded rods.

The lid assembly may be designed to have some flexibility, which allows it to adjust to slight distortions of the container body as can be observed, e.g., in a lyophilization tray. Preferably, the lid assembly is flexible such that the lid assembly fits tightly on top of the mouth of the drying container when a pressing force is applied to the lid assembly.

The pressing force may be applied through one or more fastening means to reversibly attach the container body to the lid assembly such as clamps, screws and magnetic fastening means. Said fastening means may be used in variable numbers and variable positions along the container body.

Both, the upper frame F2 as well as the lower frame F1 preferably comprise a broad rim. The width of the broad rim is preferably from 0.5 cm to 12 cm. The broad rim rims of the lower frame F1 and the upper frame F2 at least partially overlap and act as a clamp to securely hold the sheet between the two frames. In order to securely hold the sheet, it is preferred that the overlap region formed by the two broad rims has a width which is preferably from 0.5 to 10 cm, more preferably from 1 to 10 cm, and most preferably from 2 to 7 cm.

For an efficient freeze-drying of material covered using the proposed lid assembly, the exposed area of the sheet should be as large as possible during the drying process. A large exposed area of the sheet is important to enable the efficient transfer of vapor/solvent, thereby avoiding a high vapor/solvent pressure inside the drying container as compared to inside the drying chamber. The exposed area of the sheet is the area of the sheet, which is not in direct contact with either the lower frame F1 or the upper frame F2. It should be noted that the exposed area of the sheet will usually vary between drying conditions and the conditions before or after the drying process: During the drying process, the pressure inside the container will usually be slightly higher than outside, due to the evaporating solvent. This typically results in some type of outward bulging of the sheet, thereby minimizing the contact area between the sheet and the lower frame F1.

The lower frame F1 preferably comprises a broad rim and the at least one opening in the base area of the lower frame F1. Said opening may be formed as a single opening enclosed by the rim, or as a plurality of openings, the rim enclosing the plurality of openings, or as a plurality of holes, wherein the rim is free of holes. Likewise, the at least one opening in the base area of the upper frame F2 is preferably formed as a single opening enclosed by the rim, or as a plurality of openings, the rim enclosing the plurality of openings.

In order to provide a large exposed area of the sheet, it is preferred to choose the size of the single opening or the combined size of the plurality of openings and/or holes as large as possible. The largest area is provided by a single opening which claims essentially the entire base area of the lower frame F1 and of the upper frame F2, respectively. However, especially for large containers, the sheet should not span a large area unsupported in order to prevent the sheet from touching the contents of the lyophilization container. Likewise, supports should be provided to limit the outward bulging of the sheet so as to avoid it contacting the upper walls of the lyophilization chamber. Thus, arranging a plurality of openings at least in the lower frame F1 is preferred. This allows for the arrangement of a support grid or support braces, which provide support for the sheet. It is preferred to arrange the support grid or support braces such that the exposed area of the sheet is maximized under drying conditions. An example of one such arrangement is shown in FIG. 3.

Further, there may be the need to minimize uncontrolled evaporation of explosive solvents and protect against electrostatic discharges, especially if the sheet is not electrically conducting. In order to provide for a good protection against electrostatic discharges, it is preferred to use a lower frame F1 made from an electrically conducting material having a plurality of evenly distributed holes in the base area. Before drying, the exposed area of the sheet is small, because it contacts the lower frame F1, thereby minimizing evaporation of the solvent: Evaporation can occur only through those pores of the sheet which are positioned on top of one of the holes in the base area of the lower frame F1. However, under the conditions of (freeze-) drying, when a vacuum is applied outside the drying container and the sheet bulges outward, the exposed area of the sheet is markedly increased so as to enable efficient solvent removal. An example of this embodiment of the invention is shown in FIG. 4. The size and number of the holes in the base area of the lower frame F1 is preferably chosen such that under the conditions of (freeze-) drying, the pressure difference between both sides of the sheet is larger than the pressure difference between both sides of the lower frame F1. This may be achieved, e.g., if the total area of the holes (=the sum of the holes' areas) in the base area of the lower frame F1 is at least three times the total area of the pores (=the sum of the pores' areas) of the sheet. Each hole may have essentially the same diameter, e.g., a diameter of between 5 and 50 mm and the material between the holes preferably provides a dense network of electric conductors.

Preferably, the lower frame F1 and/or the upper frame F2 are made from a metal. A particularly suitable metal is stainless steel.

In principle, any vapor permeable sheet may be used with the present invention. As stated before, the sheet must be vapor permeable in order to allow for evaporation of the liquid during the drying process. The permeability of a given sheet may differ for different solvent vapours. It has been found that sheets allowing a passage of at least 10 l, preferably at least 50 l, of air per minute and $dm^2$ of membrane area at a transmembrane pressure of 200 Pa (>10 l air/min/$dm^2$, preferably >50 l air/min/$dm^2$) are particular suitable for use with the present invention in that they enable efficient passage of water/solvent vapor. Hence, a preferred vapor permeable sheet allows the passage of at least 10 l, more preferably at least 50 l, of air per minute and $dm^2$ of membrane area at a transmembrane pressure of 200 Pa (>10 l air/min/$dm^2$, preferably >50 l air/min/$dm^2$).

The sheet, which forms part of the lid's top wall and hence separates the container's content from the surroundings, will provide a barrier to particulate matter and optionally also to liquids. In the context of the present invention, "providing a barrier to particulate matter and/or to liquids" means that solid/and or liquid material is at least partially contained. Any sheet will do so, due to its sheet structure and its position within the lid assembly.

Particulate matter, especially airborne particulate matter, may emerge during drying or freeze-drying. The sheet is preferably constructed such that it is essentially impermeable for particles emerging during the drying or freeze-drying process, i.e. during the drying steps and subsequent steps such as ventilation of the drying chamber and resuspension of the material. Hence, in one embodiment, a vapor permeable sheet is used which provides a barrier to airborne solid particles emerging during the drying or freeze-drying process. Typically, the average size of such emerging particles is between 1 μm and 100 μm as measured by Focused Beam Reflectance Measurement (FBRM) technology. However, the particle size may be larger or smaller, depending on the specific dried product and drying protocol.

In practice, the sheet will usually be chosen such that a specific containment level is achieved for a specific drying process with a given drying container according to the invention. The sheet will be chosen such that the mass concentration of dried material in the air of the drying chamber is below a specific value after completion of the drying process with the maximally used load of material to be dried. The required level of containment depends on the nature of the material to be dried. Typical values are, e.g., selected from below 0.05 $\mu g/m^3$, below 0.1 $\mu g/m^3$, below 1 $\mu g/m^3$, and below 10 $\mu g/m^3$. Hence, in one preferred embodiment, a vapor permeable sheet is used, which allows containment of the dried material at a required level. For example, a vapor permeable sheet may be used which allows containment of the dried material such that its maximal concentration in the air of the drying chamber is below 10 $\mu g/m^3$, below 1 $\mu g/m^3$, below 0.1 $\mu g/m^3$, or below 0.05 $\mu g/m^3$. The skilled person will routinely carry out tests with different sheet materials to select an appropriate sheet for his/her specific purposes. Such tests may, e.g., be carried out as described in examples 1 and 2.

Preferably, a vapor permeable sheet is used, which is liquid repellent with respect to the liquid component of the sample to be dried, i.e. the sheet's surface will not be wetted or soaked by said liquid. For example, if the sample to be dried is an aqueous solution or suspension, a sheet with an apolar surface (e.g. from PTFE) will be liquid repellent: Water will not wet such a surface, but drip off, which helps to contain liquid spills caused by splashes. Vapor permeable sheets, which are repellent with respect to organic solvents, are likewise commercially available.

Depending on the specific use, not only the sheet's barrier function as detailed above, but also additional criteria may influence the selection of the sheet. For example, it may be desirable that the sheet is chemically stable, does not release extractables or leachables, and is certified for use in a certain setting.

Preferably, the sheet is selected from a) a microporous membrane, b) a nonporous, moisture permeable film, and c) a filter paper. A suitable microporous membrane may for example be made from a material selected from PTFE (polytetrafluoroethylene), expanded PTFE (polytetrafluoroethylene) or PET (polyethylene terephthalate), and composite materials comprising the above. Composite materials may comprise a membrane layer and a support layer. Preferably, the membrane's pore size is in the range from 0.2 to 100 micrometers, more preferably 1 to 25 micrometers, most preferably from 1 to 7 micrometers. A suitable non-porous, moisture permeable film may be for example selected from one or more copolyether ester elastomers such as DuPont™ Hytrel®. The expression "non-porous", as used herein, refers to the absence of penetrating pores in both sides of the film as assessed by examination with an electron microscope at a magnification factor of 10,000. Microporous filters as the paper-like Tyvek® may likewise be suitable. In particularly preferred embodiments, the sheet is a PTFE (polytetrafluoroethylene) membrane with 1-2 μm pore size or a PET (Polyethylenterephthalate) membrane with 7 μm pore size.

Preferably, the sheet is arranged such that the edges of the sheet are folded back to form a double layer of the sheet within the circumferential channel. By folding the sheet to form a double layer the gasket-like effect of the sheet is enhanced.

The lid assembly may further comprise at least one port.

The port may be configured as a fixed port having a port opening in the lower frame F1 and/or a port opening in the upper frame F2, and an opening in the sheet, the port openings and the opening in the sheet being aligned and surrounded by a connector arranged on the lower frame F1 or the upper frame F2. The connector is fixed to the lower frame F1 or to the upper frame F2 for example by welding. When the port is not in use it is covered by a cap attached to the connector.

Alternatively, the port may be configured as a mobile port having a port opening in the lower frame F1 and/or a port opening in the upper frame F2, the port openings being aligned and covered by the sheet prior to the use of the port.

The mobile port provides a possibility for arranging a port if needed. If the port is not needed, the sheet covers the openings in the lower frame F1 and/or in the upper frame F2 so that no further caps are required. In order to use the mobile port, the sheet is cut to provide a through opening in the lid assembly and a threaded nipple having a through hole and a flange-like lower end is pushed through the opening so that the flange-like structure abuts the respective frame. The nipple is then secured, e.g., by screwing a cap nut onto the nipple. The mobile port may be closed when not in use by attaching a cap to the nipple.

In one embodiment, the mobile and/or fixed ports are positioned in an area of the frame, which is depressed relative to the frame's rim. Such an arrangement is particularly preferred for use with fixed ports in the lower frame. As a result, when the lid is assembled, the fixed port's connector or mobile port's nipple will protrude less above the level of the upper frame F2's rim, as compared to an embodiment where the ports are positioned in an area of the frame, which is at level with the frame's rim.

A further aspect of the invention is to provide a drying container. The drying container comprises a container body having a bottom and at least one side wall, the side walls defining a mouth of the container body, the mouth having a contact surface enclosing said mouth, and one of the described a lid assemblies, wherein the contact surface engages the circumferential channel of the lid assembly.

The width of the contact surface is preferably chosen from 0.5 to 5 cm, more preferably from 0.5 to 2 cm. The width of the contact surface may be identical to the thickness of the side walls of the container. Alternatively, a rim may be arranged surrounding the mouth of the container in order to enlarge the contact surface.

Preferably, the drying container further comprises one or more fastening means to reversibly attach the container body to the lid assembly. The fastening means are preferably selected from clamps, screws and magnetic fastening means.

The container body is preferably made from a metal. A suitable metal is for example stainless steel. The container may for example be obtained by welding from a flat plate or by deep-drawing.

Typical drying containers have a width in the range of 20 to 40 cm, a length in the range of from 30 to 80 cm and a height of from 3 to 15 cm. It should be noted, however, that one advantage of the present invention is that the size and shape of the drying container is very flexible and can be adapted to the specific needs encountered, e.g. to allow for optimal use of space in a given drying chamber.

It is a further aspect of the invention to provide a method for drying of materials. The method comprises the following steps:

a) introducing the material to be dried into a container body, b) closing said container body by means of one of the described lid assemblies, and c) exposing the closed drying container to conditions suitable to effect drying, wherein steps a) and b) can be carried out in any order.

In step a) of the method, the material to be dried may be introduced prior to closing the container by means of a lid assembly. If the material is introduced after the container has been closed, it is preferred for the lid-assembly to comprise at least one port through which the material can be introduced.

Drying according to step c) may be effected by placing the container into a lyophilization chamber.

A further aspect of the invention is the use of one of the described lid assemblies or one of the described drying containers for the freeze-drying of material.

The embodiments of the invention described herein can advantageously be used to dry or freeze-dry bulk materials, in particular solutions comprising active pharmaceutical ingredients.

The present drying containers may be used for different purposes and uses. They are flexible in that the various embodiments of the lower frame F1 and the upper frame F2 can be combined with an appropriate sheet and container body to meet the requirements of a specific drying process. As a further advantage, they comprise only few single use parts, and most of the container parts can be continuously recycled.

The drying containers are assembled from cleaned multi-use parts (e.g. container body, frames F1 and F2, spring clamps) and new single use parts (e.g. sheet, screw nuts, screw caps). Optionally, the assembly may be performed in a clean room, and assembled drying containers may be sealed in plastic film for storage.

The drying containers are then transferred to the drying chamber and the material to be dried is introduced. This may be done, in the case of liquid solutions, by pumping the liquid through one of the drying container's ports into the closed container, or by transferring the material onto the container body and closing the lid afterwards.

After completion of the drying program and venting of the drying chamber, the drying containers are removed from the drying chamber and transferred to an area suitable for unloading such as a glove box. The dried product is retrieved from the unloading area in suitably packaged from, e.g. in a bottle or a continuous liner.

After unloading of the drying containers, they are transferred, e.g. in a closed trolley, to a suitable area for disassembly and decontamination. This may likewise be a glove box. Single use parts are discarded and the decontaminated multi-use parts are transferred to a cleaning facility. After cleaning, the use cycle recommences.

The following figures, claims and examples, including the experiments conducted and the results achieved, are provided for illustrative purposes only and are not to be construed as limiting the scope of the claims. Container bodies and lid assemblies of any shape are possible and are not limited to the relative dimensions or the rectangular shape shown in drawings.

Figure 1:
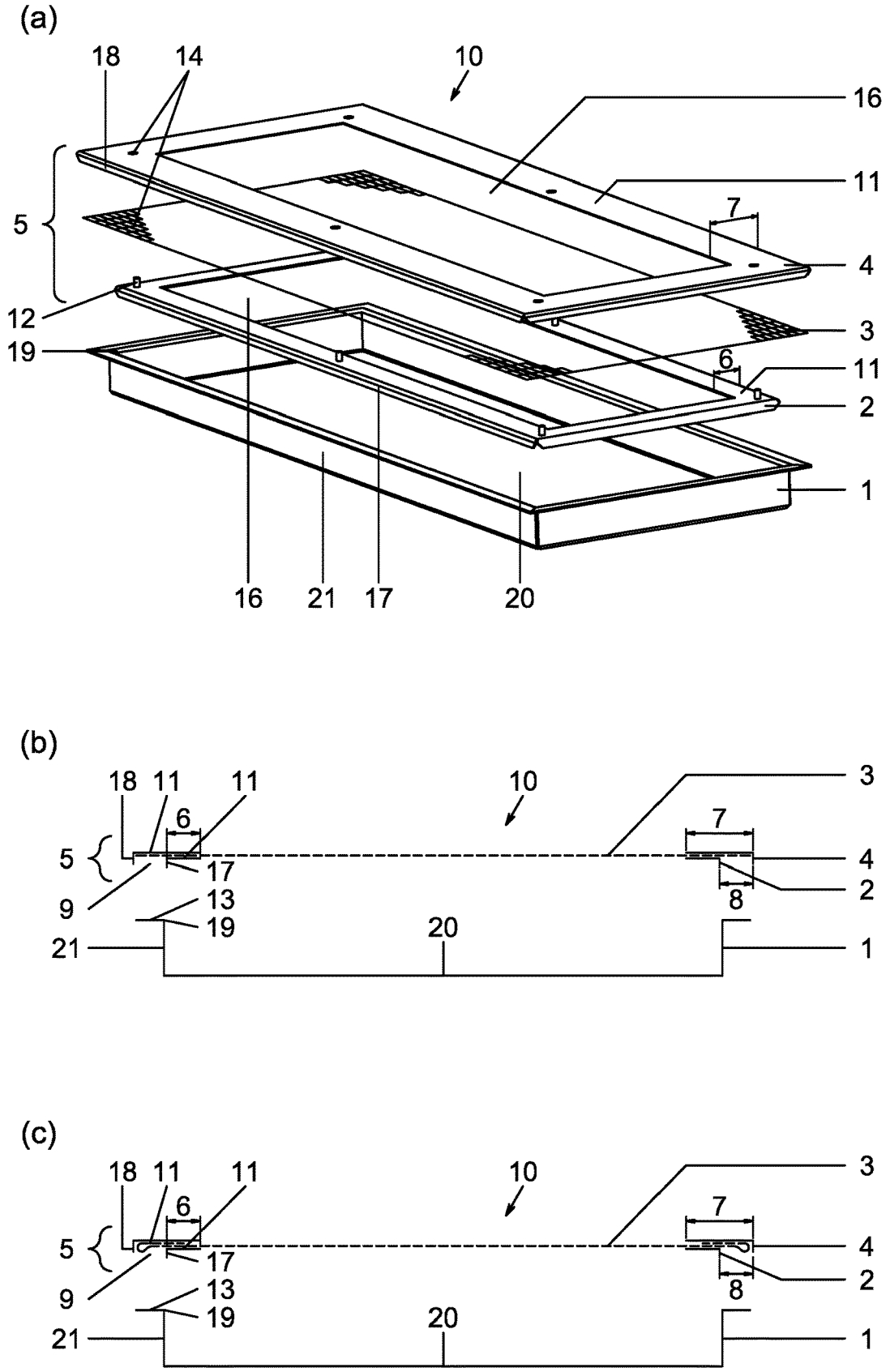
FIG. 1*a* shows an exploded view of one embodiment of the drying container of the present invention with a first embodiment of the lid assembly.
FIG. 1*b* shows a cross sectional view of the drying container.
FIG. 1*c* shows a cross sectional view of the drying container with a folded sheet.

FIG. 1*a* shows an exploded view of one embodiment of the drying container 10 of the present invention with a first embodiment of the lid assembly 5. The drying container 10 comprises a container body 1 having a bottom wall 20 and four side walls 21 defining a mouth 19 of the container body 1.

The lid assembly 5 comprises a lower frame F1 2, a vapor permeable sheet 3, and an upper frame F2 4, which are stacked in this order. The frames 2, 4 are each shaped like an open box with four side walls 17, 18. Each of the frames 2, 4 has a rim 11 surrounding an opening 16. The width of the rim 11 of the lower frame F1 2 is marked with the reference numeral 6 and the width of the rim 11 of the upper frame F2 4 is marked with the reference numeral 7. The sheet 3 is positioned between the two frames 2, 4 such that it is clamped between the rims 11 of the two frames 2, 4.

The lid assembly 5 is held together by means of threaded rods 12 attached to the lower frame F1 2. These threaded rods 12 extend through holes 14 in the sheet 3 and the upper frame 4. After assembly of the lid assembly 5, screw nuts (not shown) are put onto the threaded rods 12 to secure the lid assembly 5.

FIG. 1*b* shows a cross sectional view of the drying container 10 as described in FIG. 1*a*.

The lid assembly 5 is shown in an assembled state with the sheet 3 securely held between the lower frame F1 2 and the upper frame F2 4. The two frames 2, 4 define a circumferential channel 9 having a channel width 8. The rim 11 of the upper frame F2 4 defines a top wall of the channel 9, the side walls 18 of the upper frame F2 4 define outer walls of the channel 9 and the side walls 17 of the lower frame F1 2 define inner walls of the channel 9.

The container body 1 has a bottom wall 20 and side walls 21 which define a mouth 19 of the container body 1. The mouth 19 has a contact surface 13 with a width which is chosen such that the mouth 19 may engage in the channel 9 when the lid assembly 5 closes the drying container 10. The sheet 3 extends into the channel 9 and at least partially covers the top wall of the channel 9. When the drying container 10 is closed, the part of the sheet 3 which is located inside the channel 9 serves as a gasket to seal the drying container 10.

FIG. 1*c* shows a variation of the lid assembly 5 of the drying container 10 as described in FIGS. 1*a* and 1*b*. The sheet 3 of the lid assembly 5 is arranged in the channel 9 such that the edges of the sheet 3 are folded back to form a double layer of the sheet 3 within the circumferential channel 9. By folding the sheet 3 to form a double layer the gasket-like effect of the sheet is enhanced.

FIGS. 2*a* to 2*g* show several embodiments of plates which may be folded into a lower frame F1 or an upper frame F2 by folding the flaps 22 by 90°. The fold lines are shown as dashed lines in FIGS. 2*a* to 2*g*. It should be noted that similar shapes of the lower and upper frames F1 and F2 can be obtained by other techniques such as deep drawing.

If the plate is used as lower frame F1, rods, e.g. threaded rods, may be attached to the plate. If the plate is used as upper frame F2, through holes may be drilled for attachment onto the rods of a lower frame F1.

Figure 2:
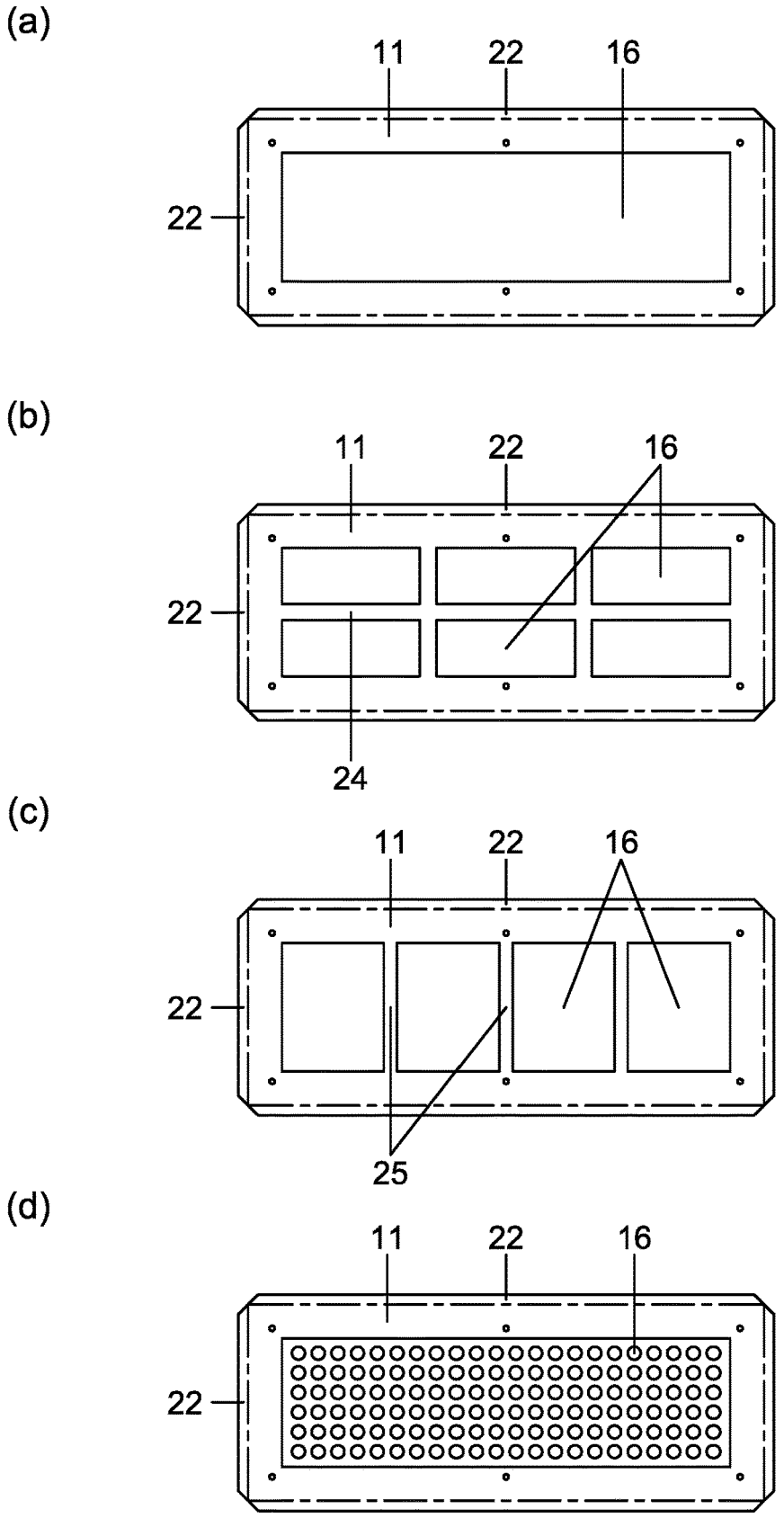
FIGS. 2*a* to 2*h* show different embodiments of upper and/or lower frame.
Figure 2:
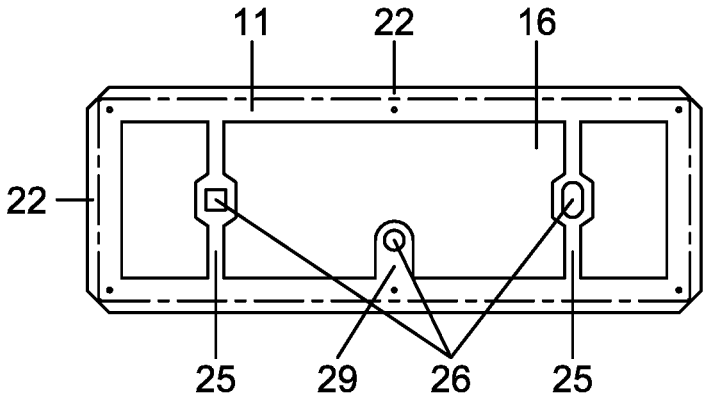
Figure 2:
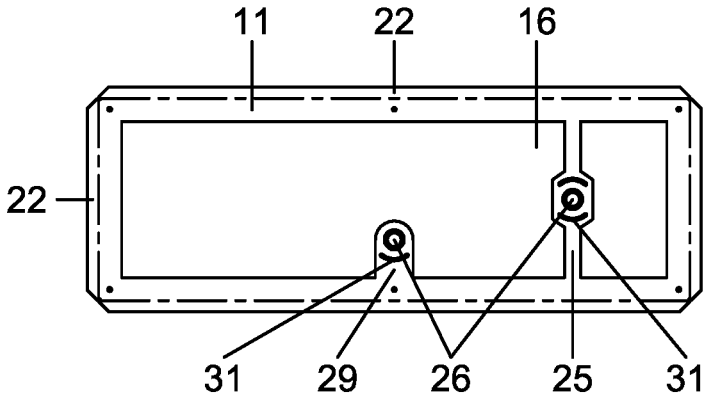
Figure 2:
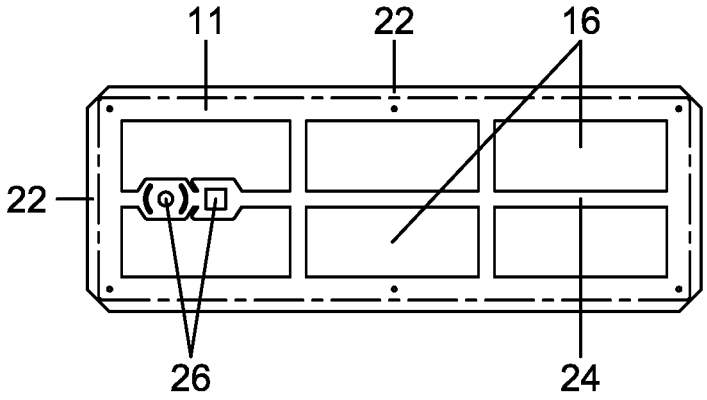
Figure 2:
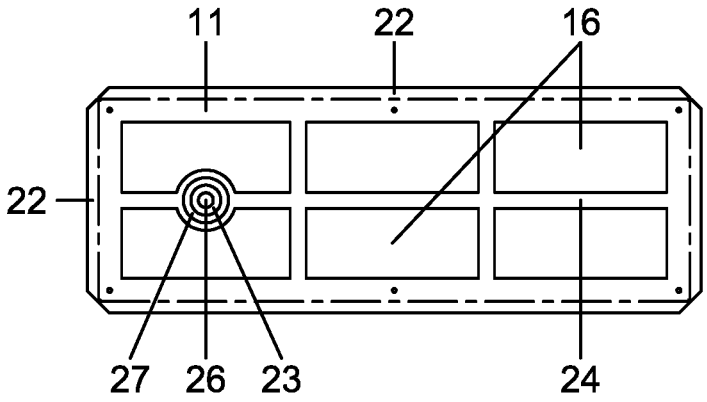
Figure 2:
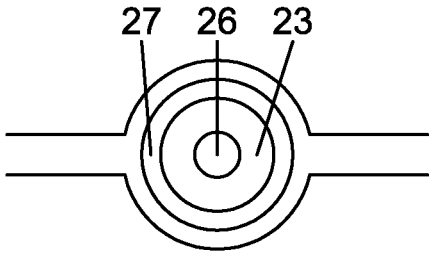
Figure 2:
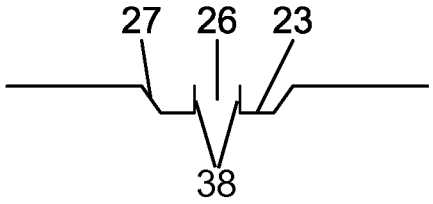

In FIG. 2*a* the plate has one single opening 16 which is surrounded by a rim 11. Both the opening 16 and the rim 11 have a rectangular shape. Four flaps 22 abut the four sides of the rim 11 and may be folded by 90° to form side walls 17, 18 of the frames.

FIG. 2*b* shows an embodiment of the plate having six openings 16 arranged in three columns and two rows. The six openings 16 are surrounded by the rim 11. The material of the plate between the openings 16 forms a support grid 24.

FIG. 2*c* shows an embodiment of the plate having four openings 16 arranged in four columns and one row. The four openings 16 are surrounded by the rim 11. The material of the plate between the openings 16 forms support braces 25.

FIG. 2*d* shows an embodiment of the plate having a plurality of holes 15 which serve as openings 16. The holes 15 are arranged in a regular pattern inside an area surrounded by the rim 11. The rim 11 is free of holes 15.

FIG. 2*e* shows an embodiment of the plate having support braces 25 with included port openings 26. The port openings 26 may be used to attach a mobile port to the frame, and their shape may be chosen depending on the shape of the mobile port, e.g. from square, round, or oval. The width of the support brace 25 is larger in the area surrounding the port opening 26 in order to provide sufficient stability. Alternatively, a support grid 24 with included port openings 26 may be used. Another alternative is arranging a port opening 26 on a tab 29 which projects from the rim 11 into the space of the opening 16.

The number and arrangement of port openings 26 on the plate may be varied. Further, the shape of the port openings 26 may be chosen as required. Examples for suitable shapes of a port opening 26 include circles, ovals and polygonal shapes such as squares or rectangles.

FIG. 2*f* shows a variant of the plate of FIG. 2*e* wherein the port openings 26 are configured for welding of a connector to the port opening 26. Cuts 31 are provided to compensate for warping due to the welding.

FIG. 2*g* shows a plate having six openings 16 and a support grid 24 similar to the embodiment of FIG. 2*b*. Further, two port openings 26 are provided wherein one of the port openings is provided with cuts 31 to compensate for warping when a connector is welded to the port opening 26.

FIG. 2*h*, panel (i) shows a plate having six openings 16 and a support grid 24 similar to the embodiment of FIG. 2*b*. Further, a port opening 26 is provided wherein the port opening is located in a cup-like recess of the support grid, such that the port opening and the bottom 23 of the cup-like recess are lowered relative to the level of the rim 11. Because the walls 27 of the cup-like recess limit warping, no cuts 31 are needed when a connector is welded to the port opening 26. Panel (ii) shows a blow-up of the part of the support grid, which comprises the port opening. Panel (iii) shows a cross-section of this area in an embodiment where the port is configured as a fixed port with a welded connector 38.

Figure 3:
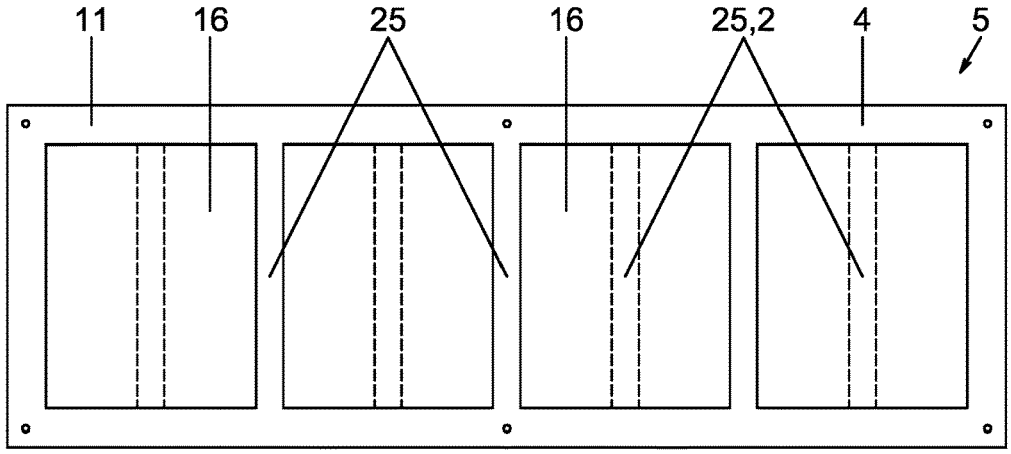
FIG. 3*a* shows a top view of a second embodiment of the lid assembly.
FIG. 3*b* shows a cross sectional view of the second embodiment of the lid assembly
Figure 3:
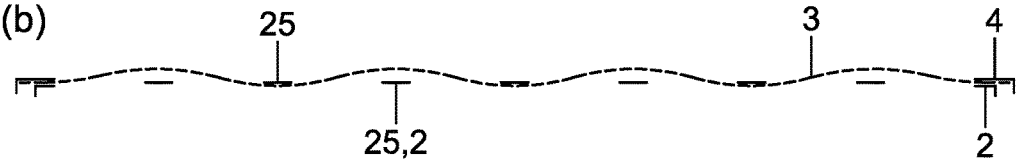

FIG. 3*a* shows a top view of a second embodiment of the lid assembly 5.

The upper frame F2 4 is configured with three support braces 25 as described with respect to FIG. 2*c* and has four openings 16. The lower frame F1 2 is configured with four support braces 25. The support braces 25 of the lower frame F1 2 do not overlap with the support braces 25 of the upper frame F2 4. Thus, the lower frame F1 has five openings 16 which partially overlap with the four openings 16 of the upper frame F2.

FIG. 3*b* shows a cross sectional view of the second embodiment of the lid assembly 5.

In the situation shown in FIG. 3*b* a freeze-drying operation is in progress. The sheet 3, which is held between the lower frame F1 2 and the upper frame F2 4, bulges outward due to a pressure difference. The outward bulging is limited by the support braces 25 of the upper frame F2. When there is no pressure difference, the sheet 3 rests on the support braces 25 of the lower frame F1.

By the alternating arrangement of the support braces 25 of the two frames 2, 4 most of the area of the sheet 3 is exposed during the freeze-drying process. Only the area covered by the support braces 25 of the upper frame F2 4 is covered up.

Figure 4:
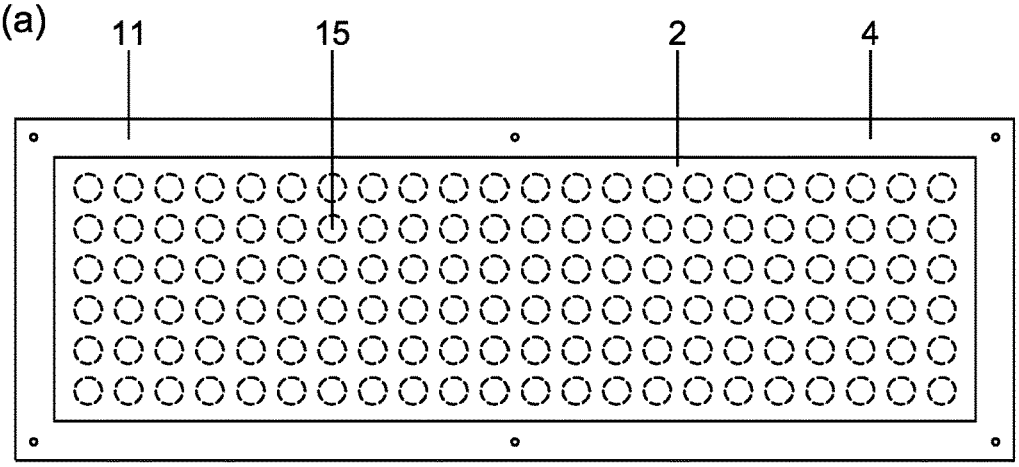
FIG. 4*a* shows a top view of a third embodiment of the lid assembly.
FIG. 4*b* shows a cross sectional view of the third embodiment of the lid assembly with the sheet resting on the lower frame F1.
FIG. 4*c* shows a cross sectional view of the third embodiment of the lid assembly during the drying process.
Figure 4:
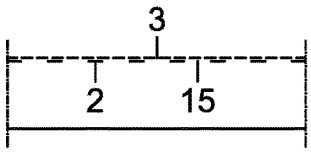
Figure 4:
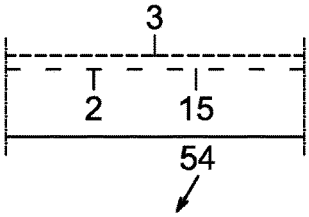

FIG. 4*a* shows a top view of a third embodiment of the lid assembly 5.

The lower frame F1 2 is configured as described with respect to FIG. 2*d* and the upper frame F2 4 is configured as described with respect to FIG. 2*a*. The sheet 3 is held between the two frames 2, 4 and rests on the lower frame F1 2 when there is no pressure difference.

FIG. 4*b* shows a cross sectional view of the third embodiment of the lid assembly 5 with the sheet 3 resting on the lower frame F1 2. In the situation shown in FIG. 4*b* there is no pressure difference between the inside of the drying container 10 and the outside. Thus, the sheet resets on the lower frame F1 2 and the exposed area of the sheet is small, thereby limiting evaporation of the solvent. If a non-conductive sheet material is used, electrostatic charges may discharge over the material of the lower frame F1 2 which is in close contact with the sheet 3.

FIG. 4*c* shows a cross sectional view of the third embodiment of the lid assembly 5 when in use in a freeze-drying process. In the situation shown in FIG. 4*c* there is a pressure difference between the inside of the drying container and the outside so that the sheet 3 bulges outwards. The sheet 3 is held between the rims of the two frames 2, 4 but does not rest on the lower frame F1. As can be seen in FIG. 4*c*, nearly the entire area of the sheet 3 is exposed and may effectively be used in the freeze-drying process.

FIGS. 5*a* to 5*d* show different embodiments of ports 28, all of which are drawn in a cross sectional view.

Figure 5:
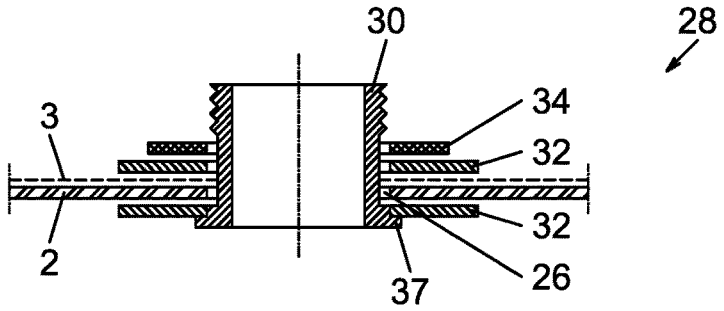
FIG. 5*a* shows an embodiment of a mobile port arranged on the lower frame F1.
FIG. 5*b* shows an embodiment of a mobile port arranged on the upper frame F2.
FIG. 5*c* shows an embodiment of a fixed port arranged on the lower frame F1.
FIG. 5*d* shows an embodiment of a fixed port arranged on the upper frame F2.
Figure 5:
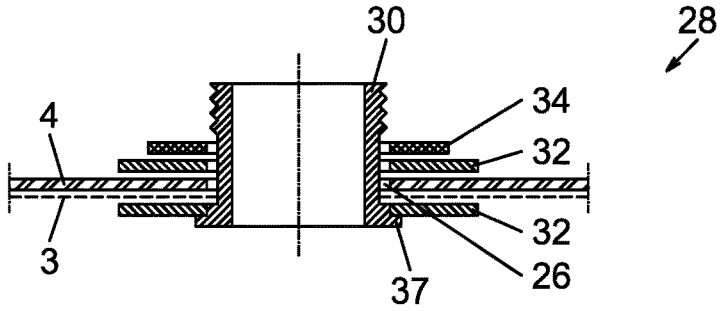
Figure 5:
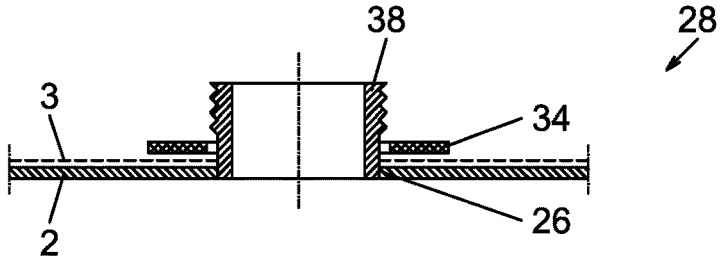
Figure 5:
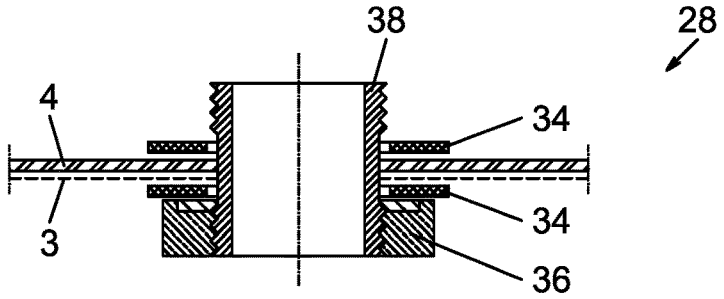

FIG. 5*a* shows an example of a mobile port arranged on a lower frame F1 2.

A threaded nipple 30 with a through hole and a projecting rim 37 at the lower end is inserted through the port opening 26 in the lower frame F1 2. The projecting rim 37, which is not necessarily circumferential, keeps the threaded nipple 30 from slipping through the port opening 26 and/or provides a counter surface for an optional washer 32. The sheet 3 rests on the lower frame F1 2 under an optional second washer 32. A seal 34 surrounds the nipple 30 and the threaded nipple 30 is secured using a screw cap or a screw nut (not shown). The cap may be closed or have a through hole. It should be noted that the outer circumference of the threaded nipple's lower end is not necessarily circular, but may be adjusted depending on the shape of the opening 26.

In further embodiments a threaded nipple 30 with a lower section having a polygonal or oval shaped outer circumference may be used to provide a mobile port. Likewise, the port opening 26 has a matching polygonal or oval shape. When the lower section of the threaded nipple 30 is inserted in the corresponding port opening 26, the threaded nipple 30 is secured against rotation.

FIG. 5*b* shows an example of a mobile port arranged on the upper frame F2 4.

A threaded nipple 30 with a through hole and a and a projecting rim 37 at the lower end is inserted through an opening in the sheet 3 and the port opening 26 in the upper frame F2 4. A washer 32 is placed between the projecting rim 37 and the sheet 3. The sheet 3 rests on the washer 32. A second washer 32 can be used to support the seal 34. The seal 34 surrounds the nipple 30 and the threaded nipple 30 is secured using a screw cap or a screw nut (not shown). The cap may be closed or have a through hole.

FIG. 5*c* shows an example of a fixed port arranged on the lower frame F1 2.

A connector 38 having a thread is attached to the port opening 26 in the lower frame F2 2 by welding. The sheet 3 has an opening through which the connector 38 extends. The sheet 3 rests on the lower frame F1 2. In order to close the port 28, a seal 34 is placed over the connector 38 and a cap (not shown) is screwed onto the connector 38. The cap may be closed or have a through hole.

FIG. 5*d* shows an example of a fixed port arranged on the upper frame F2 4.

The connector 38 is inserted through the port opening 26 in the upper frame F2 4 and is fixed to the upper frame F2 4 by welding. The upper frame F2 4 is placed over the sheet 3, wherein the connector 38 is inserted through an opening in the sheet 3. A seal 34 which is secured with a screw nut 36 seals the side facing towards the inside of the container.

In order to close the port 28, a seal 34 is placed over the connector 38 and a cap (not shown) is screwed onto the connector 38. The cap may be closed or have a through hole.

Figure 6:
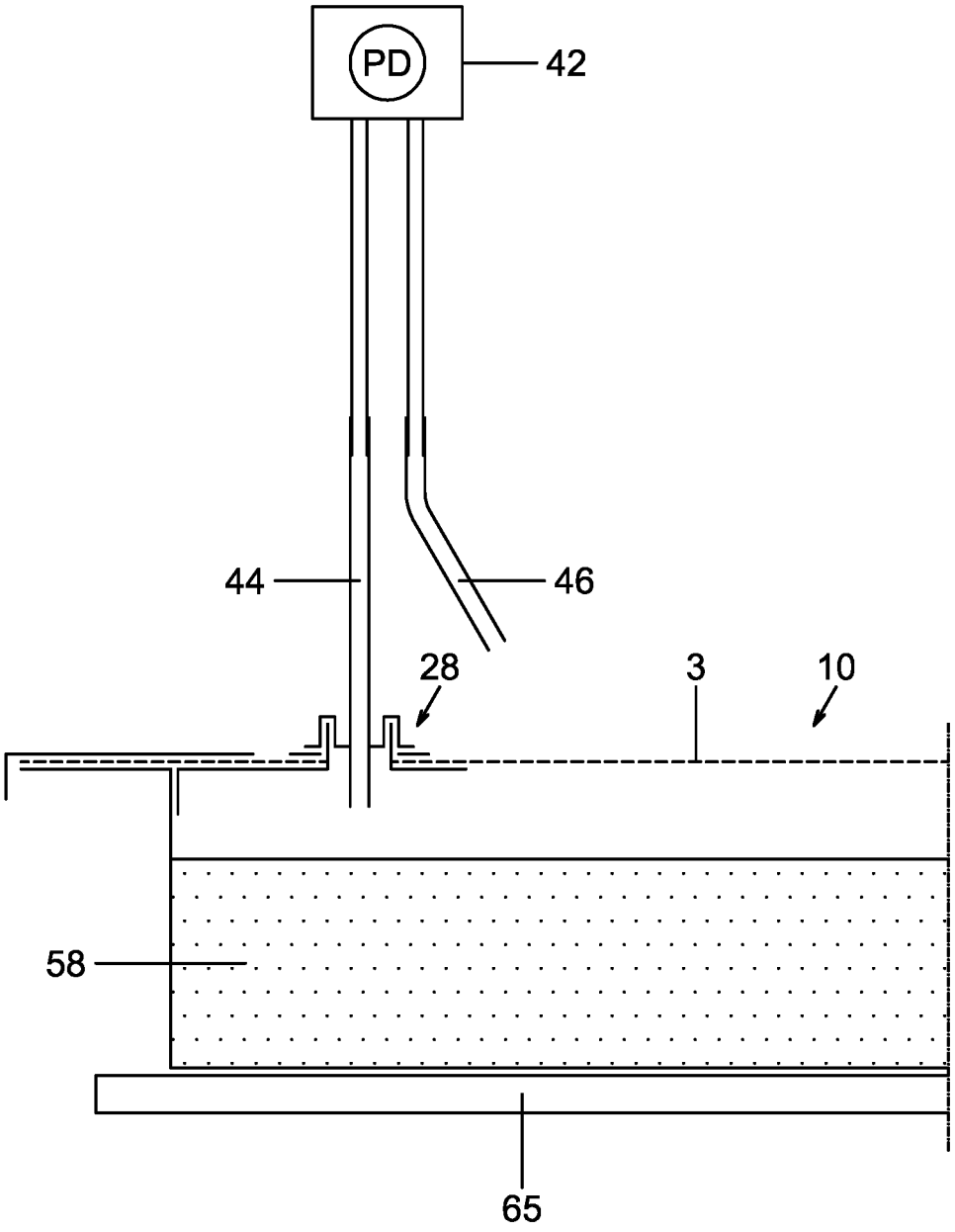
FIG. 6 shows the measurement of the pressure difference between both sides of the sheet of the drying container.

FIG. 6 shows the measurement of pressure inside the drying container 10. A differential pressure measurement device 42 is provided with a first tube 44 which is inserted through the port 28 into the drying container 10. The drying container 10 is filled with material 58 to be dried and rests on a shelf 65 of the drying chamber 40. A second tube 46 opens into the inside of the drying chamber 40. In this arrangement, the pressure difference between the inside of the drying container 10 and the inside of the drying chamber 40 may be measured. The pressure measurement device 42 may be placed inside or outside the drying chamber 40.

Figure 7:
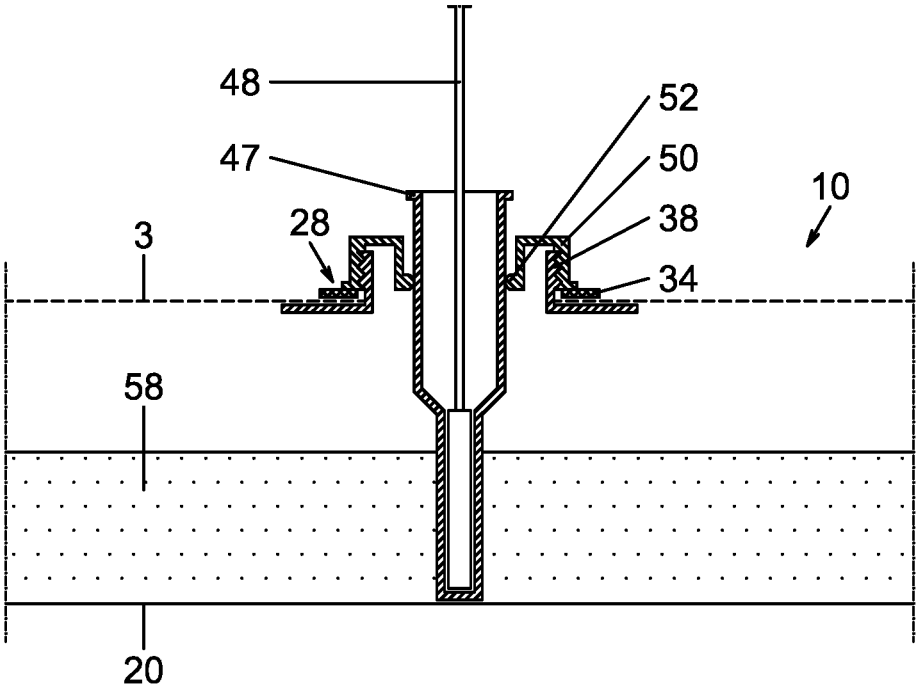
FIG. 7 shows the temperature measurement inside the drying container.

FIG. 7 shows the measurement of temperature inside the drying container 10. A guide tube 47 with a narrower lower part and a closed, thin bottom is inserted into the port 28 of a drying container 10. Preferably, the guide tube 47 is made from a material with good thermal conductivity. In order to provide a tight seal, a screw cap 50 with a through hole having a sealing lip 52 is arranged on the port 28, which is shown in this example as a fixed port with a connector 38. However, mobile ports may likewise be used. The sealing lip 52 forms a tight seal around the broader upper part of the guide tube 47. A temperature probe 48 is inserted into the guide tube, such that its sensor contacts the guide tube's bottom. In order to measure the temperature, the guide tube 47 is pushed down, until its bottom contacts the bottom 20 of the container body. In this way, the temperature in the immediate vicinity of the drying material 58 can be monitored without contaminating the temperature probe or the content of the drying container.

Figure 8:
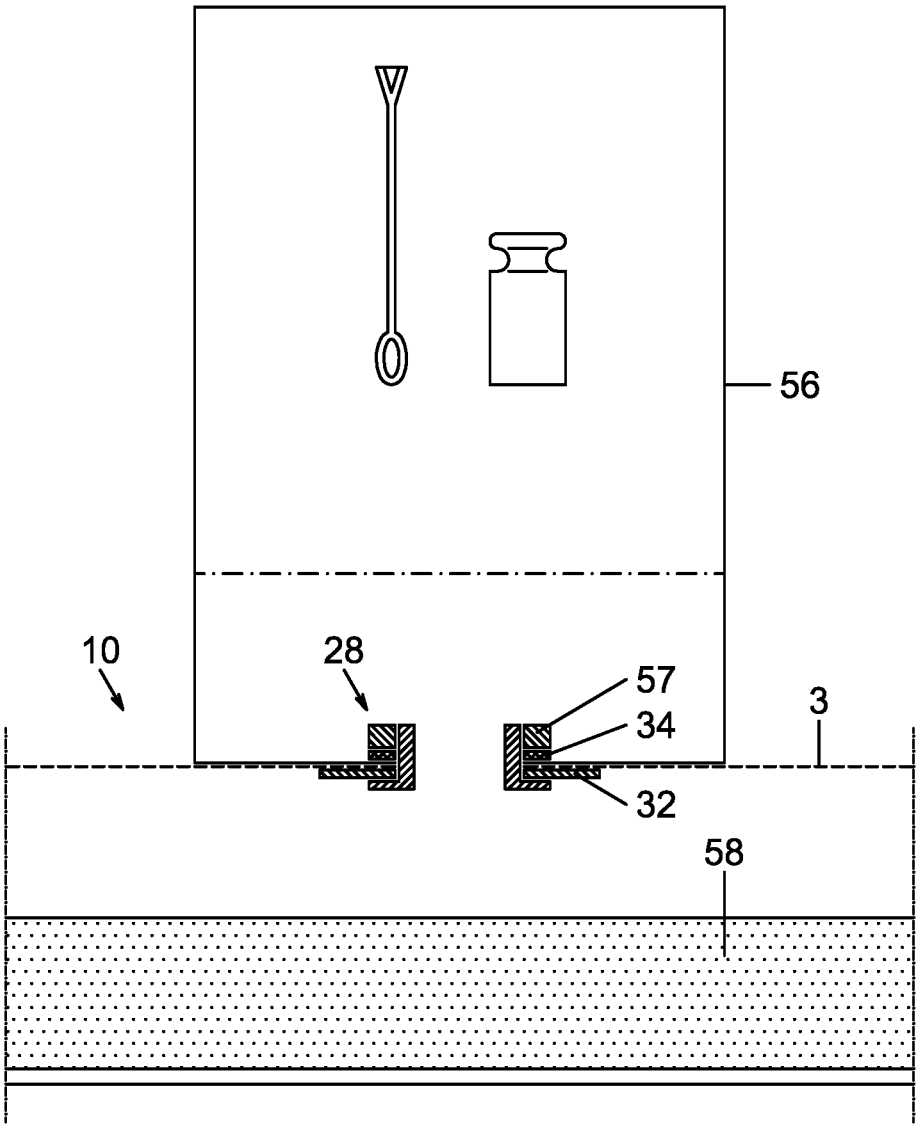
FIG. 8 depicts a material transfer though a port of the lid assembly.

FIG. 8 depicts a secure transfer of a sample of material 58 out of the drying container 10 through a port 28 of the lid assembly 5. A bag 56 is secured to the port 28 by clamping the bag 56 between the sheet 3 and the seal 34 by means of a cap nut 57. Material 58 may then transferred from the drying 10 container into the bag 56 without the danger of contamination of the surroundings. The bag 56 may then be safely removed, e.g., by applying commercially available safe seal clamps prior to separation with a cutting tool. The clamps will seal both the bag 56 itself and the reminder of the bag 56, which is left at the port 28 after separation of the bag. The place where the clamps are to be applied is schematically indicated by a dot-and-dash line.

Figure 9:
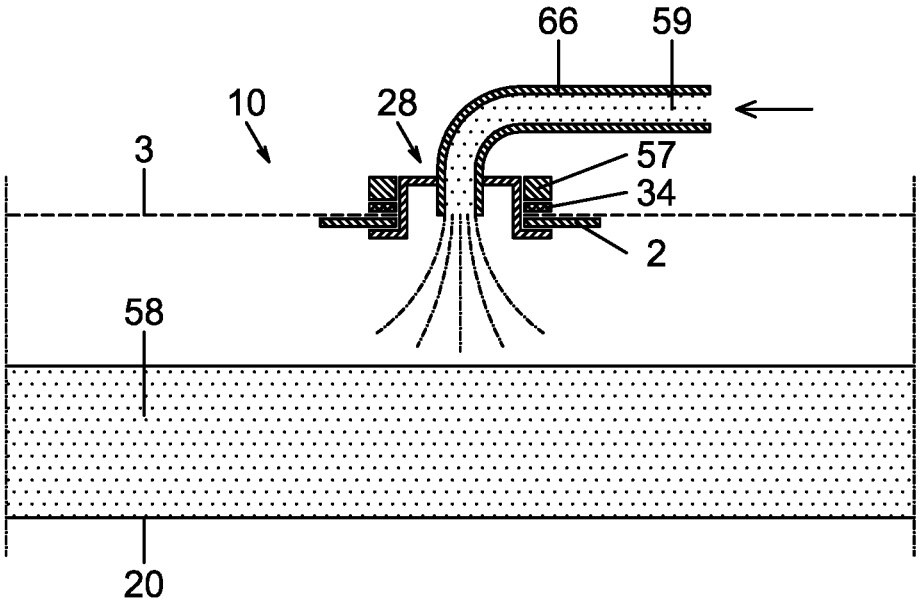
FIG. 9 shows the transfer of liquid through a port of the lid assembly.
Figure 9:
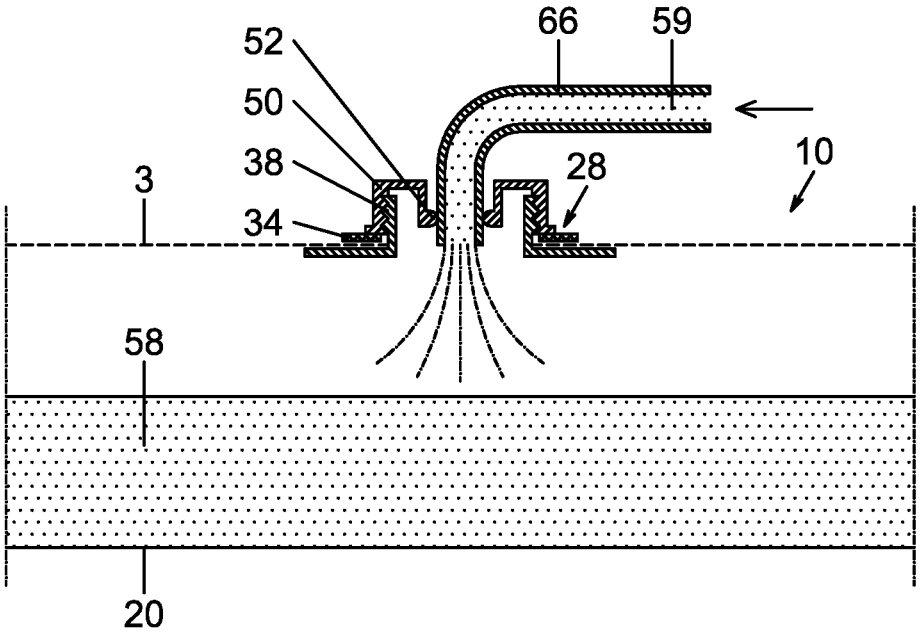

FIGS. 9*a* and 9*b* show two different embodiments enabling the transfer of liquid 59 through a port 28 of the lid assembly 5 into the drying container 10. A hose 66 is attached to the port 28 and allows the transfer of liquid 59 onto the material 58 inside the drying container 10 without the danger of contamination of the surroundings.

FIG. 9*a* shows an example of a mobile port comprising a (treaded) nipple inserted in an opening of a lower frame 2, a (screw) nut 57, and seal 34.

FIG. 9*b* shows an example of a fixed port comprising a connector 38 welded to the lower frame, seal 34, and a screw cap 50 with a through hole having a sealing lip 52. These configurations may either be used to dissolve or suspend the material 58 in the liquid 59 after completion of the drying process. Alternatively, the setup may be used to introduce the liquid material to be dried into the container 10, i.e. the material 58 and the liquid 59 may be the same.

Figure 10:
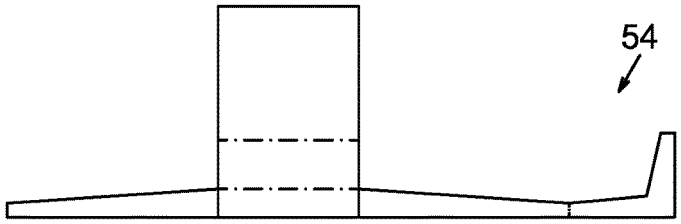
FIGS. 10*a* to 10*c* show a first embodiment of fastening means to fix the lid assembly to a container body.
FIGS. 10*d* to 10*e* show a second embodiment of fastening means to fix the lid assembly to a container body.
FIG. 10*f* shows a third embodiment of fastening means to fix the lid assembly to a container body.
Figure 10:
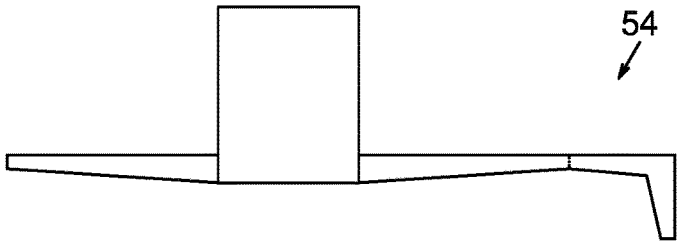
Figure 10:
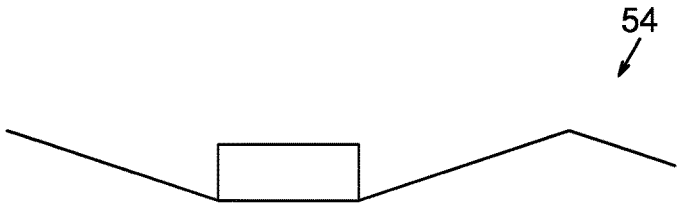
Figure 10:
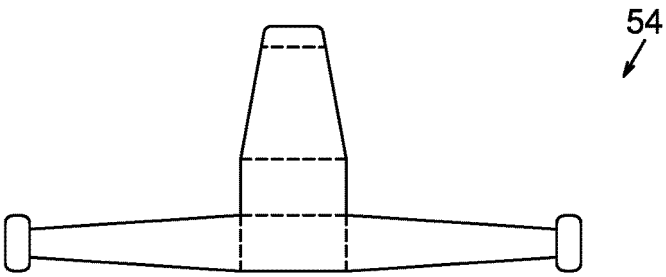
Figure 10:
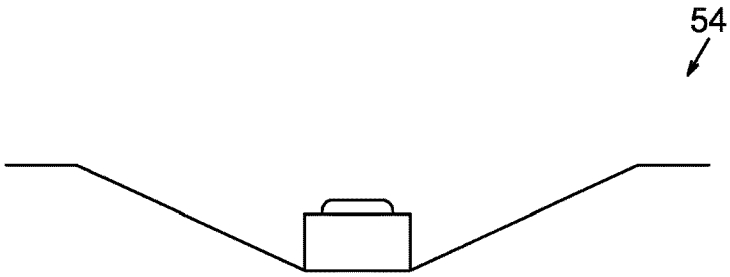
Figure 10:
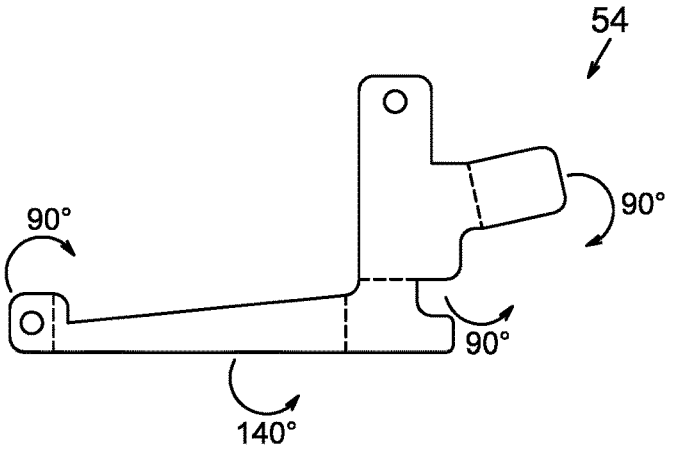

FIGS. 10*a* to 10*c* depict a first embodiment of fastening means to fix the lid assembly 5 to a container body 1. The fastening means is constructed as a clamp 54 made out of a spring steel plate. FIG. 10*a* depicts the clamp 54 after cutting the plate and before folding. The dashed lines mark the folds. FIG. 10*b* depicts the clamp 54 after folding in a top view and FIG. 10*c* depicts the clamp 54 after folding in a side view.

FIGS. 10*d* to 10*e* depict a second embodiment of fastening means to fix the lid assembly 5 to a container body 1. The fastening means is constructed as a clamp 54 made out of a spring steel plate. FIG. 10*d* depicts the clamp 54 after cutting the plate and before folding. The dashed lines mark the folds. FIG. 10*e* depicts the clamp 54 after folding in a side view.

FIG. 10*f* depicts a third embodiment of fastening means to fix the lid assembly 5 to a container body 1. The fastening means is constructed as a clamp 54 made out of a spring steel plate. FIG. 10*f* depicts the clamp 54 after cutting the plate and before folding. The dashed lines mark the folds and the fold angles are indicated.

Figure 11:
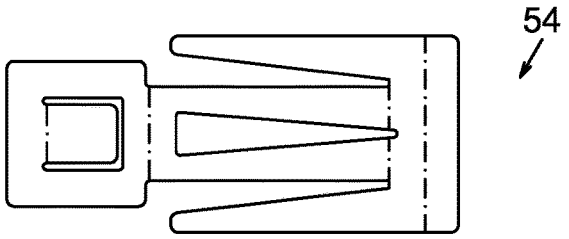
FIGS. 11*a* and 11*b* show a fourth embodiment of fastening means to fix the lid assembly to a container body.
Figure 11:
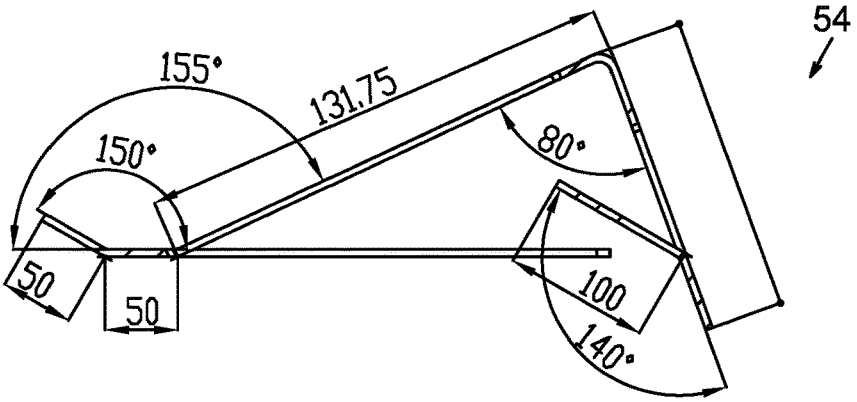

FIGS. 11*a* and 11*b* show a fourth embodiment of fastening means to fix the lid assembly 5 to a container body 1. The fastening means is constructed as a clamp 54 made out of a spring steel plate. FIG. 11*a* depicts the clamp 54 after cutting the plate and before folding. The dashed lines mark the folds. FIG. 11*b* depicts the clamp 54 after folding in a in a side view.

Figure 12:
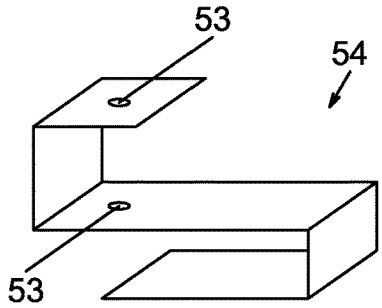
FIGS. 12*a* and 12*b* show a fifth embodiment of fastening means to fix the lid assembly to a container body.
Figure 12:
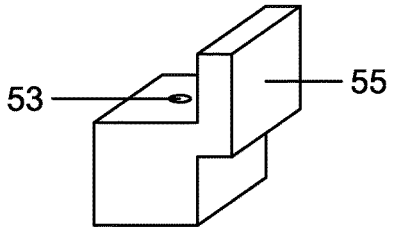

FIGS. 12*a* and 12*b* depict a fifth embodiment of fastening means to fix the lid assembly to a container body 1. The fastening means are constructed as a clamp 54 and a locking block 55. FIG. 12*a* depicts the clamp 54 in a perspective view. The clamp 54 has through holes 53 for insertion of a screw bolt (not shown). FIG. 12*b* depicts the locking block 55, which is likewise provided with a through hole 53 for insertion of a screw bolt, in a perspective view.

Figure 13:
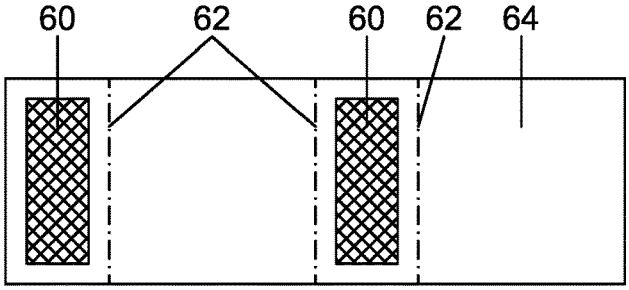
FIGS. 13*a* and 13*b* show a sixth embodiment of fastening means to fix the lid assembly to a container body.
Figure 13:
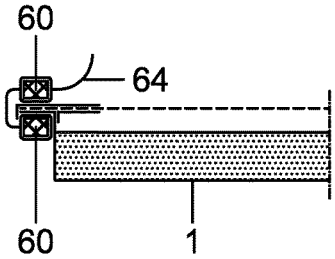
Figure 14:
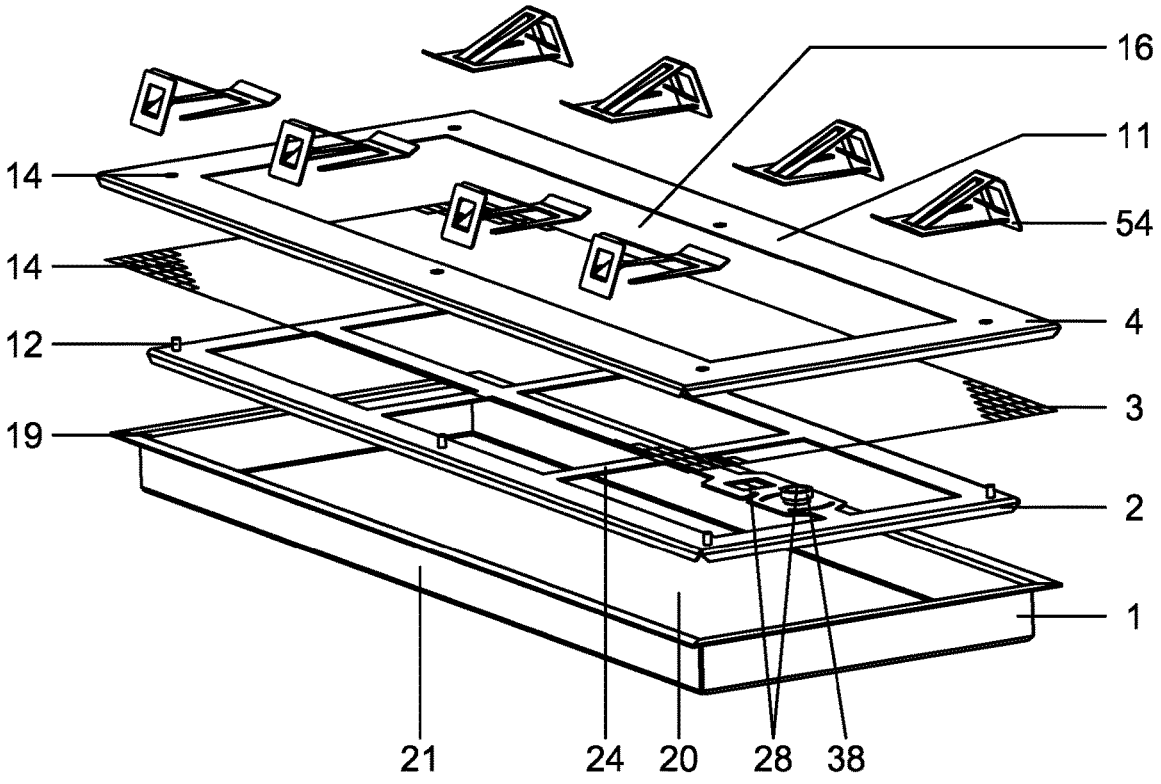
FIG. 14 shows an exploded view of a second embodiment of the drying container.

FIGS. 13*a* and 13*b* show a sixth embodiment of fastening means to fix the lid assembly 5 to a container body 1. The fastening means are constructed as magnetic fastening means having a flexible sheet 64 with two attached magnets 60. The magnets 60 are not movable along the flexible sheet 64. The magnetic fastening means are folded along fold lines 62 to secure the lid assembly 5 to the container body as shown in FIG. 13*b*. The end if the flexible sheet 64 forms a little latch facilitating the separation of the magnets in order to open the container FIG. 14 shows an exploded view of a second embodiment of the drying container 10.

The drying container 10 comprises a container body 1 having a bottom wall 20 and four side walls 21 defining a mouth 19 of the container body 1.

The lid assembly 5 comprises a lower frame F1 2, a vapor permeable sheet, and an upper frame F2 4, all of which are stacked in this order.

The lower frame F1 2 is configured as shown in FIG. 2*g* and has two ports 28. One of the ports 28 is configured as a fixed port with a connector 38 welded to the lower frame F1 2. The upper frame F2 4 is configured as shown in FIG. 2*a* and has an opening 16 which overlaps with the six opening 16 in the lower frame F2 2.

The lid assembly 5 is held together by means of threaded rods 12 attached to the lower frame F1 2. These threaded rods 12 extend through holes 14 in the sheet 3 and the upper frame F2 4.

After assembly of the lid assembly 5, screw nuts (not shown) are put onto the threaded rods 12 to secure the lid assembly 5.

The lid assembly 5 is secured to the container body 1 by means of eight clamps 54 as described with respect to FIGS. 11*a* and 11*b*.

EXAMPLES

Example 1

To investigate the need for an elastomeric seal, 20 drying containers as depicted in FIG. 14 were assembled with an additional silicone flat seal inserted between the sheet and frame F2 of the lid. The container body, lower frame F1, upper frame F2 and spring clamps were made from stainless steel, a PTFE (polytetrafluoroethylene) membrane with 1-2 μm pore size served as the sheet. The port incorporated into F1 was closed by a screw cap. The drying containers were placed onto the shelfs of a lyophilization chamber.

Each drying container was filled with about 5 l of an aqueous paracetamol solution (10 g/l) using a peristaltic pump, whose outlet tube was connected to the drying container's port. After removal of the tube, a temperature sensor was inserted into the port, the lyophilization chamber was closed, and the lyophilization program started.

After the end of the lyophilization program and venting of the lyophilization chamber, swab tests were taken on the surface of the drying containers and inside the lyophilization chamber. The surface concentration of paracetamol ranged from below the detection limit of <0.01 μg/dm2 to a maximum of 0.02 μg/dm$^2$. The concentration of paracetamol in the room air as well as on the testing probes worn by the operator was likewise below the detection limit.

The experiment was repeated with 10 drying containers, which differed from the previously used containers only by omission of the silicone flat seal.

After the end of the lyophilization program and venting of the lyophilization chamber, swab tests were taken on the surface of the drying containers and inside the lyophilization chamber. The surface concentration of paracetamol was below the detection limit of <0.01 μg/dm$^2$ in most samples and reached a maximum of 0.03 μg/dm$^2$. The concentration of paracetamol in the room air as well as on the testing probes worn by the operator was likewise below the detection limit of <0.01 μg/m$^3$. It was therefore concluded that the design of the present drying container enables safe use without the need for an elastomeric seal.

Example 2

10 drying containers as depicted in FIG. 14 were assembled and placed onto the shelfs of a lyophilization chamber. The container body, lower frame F1, upper frame F2 and spring clamps were made from stainless steel, a PET (Polyethylenterephthalate) membrane with 7 μm pore size served as the sheet, and was folded back to form a double layer within the lid assembly's circumferential channel (cf. FIG. 1*c*). The port incorporated into F1 was closed by a screw cap.

Each drying container was filled with about 5 l of an aqueous paracetamol solution (10 g/l) using a peristaltic pump, whose outlet tube was connected to the drying container's port. After removal of the tube, a temperature sensor was inserted into the port, the lyophilization chamber was closed, and the lyophilization program started.

After the end of the lyophilization program and venting of the lyophilization chamber, swab tests were taken on the surface of the drying containers and inside the lyophilization chamber. The surface concentration of paracetamol was below the detection limit of <0.01 μg/dm$^2$ in most samples and reached a maximum of 0.02 μg/dm$^2$. The concentration of paracetamol in the room air as well as on the testing probes worn by the operator was likewise below the detection limit of <0.01 μg/m$^3$.

| | |
|---|---|
| 1 | container body |
| 2 | lower frame F1 |
| 3 | sheet |
| 4 | upper frame F2 |
| 5 | lid assembly |
| 6 | rim width F1 |
| 7 | rim width F2 |
| 8 | channel width |
| 9 | channel |
| 10 | drying container |
| 11 | rim |
| 12 | threaded rod |
| 13 | contact surface |
| 14 | hole |
| 15 | holes |
| 16 | opening |
| 17 | side wall F1 |
| 18 | side wall F2 |
| 19 | mouth (container body) |
| 20 | bottom (container body) |
| 21 | side wall (container body) |
| 22 | flap |
| 23 | bottom (cup-like recess) |
| 24 | support grid |
| 25 | support braces |
| 26 | port opening |
| 27 | side wall (cup-like recess) |
| 28 | port |
| 29 | tab |
| 30 | nipple |
| 31 | cut |
| 32 | washer |
| 34 | seal |
| 36 | screw nut |
| 37 | projecting rim |
| 38 | connector |
| 40 | drying chamber |
| 42 | pressure measurement device |
| 44 | first tube |
| 46 | second tube |
| 47 | guide tube |
| 48 | temperature probe |
| 50 | screw cap with through hole |
| 52 | sealing lip |
| 53 | through hole |
| 54 | clamp |
| 55 | locking block |
| 56 | bag |
| 57 | screw nut |
| 58 | material |
| 59 | liquid |
| 60 | magnet |
| 62 | fold |
| 64 | flexible sheet |
| 65 | shelf |
| 66 | hose |

The invention claimed is:

1. A lid assembly for a drying container, comprising:

a lower frame F1, an upper frame F2, a vapor permeable sheet positioned between the two frames, and fastening means, wherein the lower frame F1 and the upper frame F2 are each shaped as an open box having a base area and at least one side wall, the lower frame F1 and upper frame F2 being arranged such that a circumferential channel is formed, an outer side wall of the channel being formed by the at least one side wall of the upper frame F2, an inner side wall of the channel being formed by the at least one side wall of the lower frame F1 and a top wall of the channel being formed by a rim of the upper frame F2, wherein a width of the channel is chosen such that a mouth of a container body of a drying container can engage in the channel, the lower frame F1 and the upper frame F2 each comprise at least one opening in the respective base areas of F1 and F2, wherein the at least one opening in the lower frame F1 at least partially overlaps with the at least one opening in the upper frame F2, the sheet covers the at least one opening in the lower frame F1 and the sheet further covers at least a part of the top wall of the channel, and the lower frame F1, the sheet, and the upper frame F2 are aligned and held together by the fastening means, the fastening means providing a releasable connection between the lower frame F1 and the upper frame F2.

2. The lid assembly according to claim 1, wherein the lower frame F1 and/or the upper frame F2 is/are a folded plate wherein the at least one side wall is folded with respect to the base area.

3. The lid assembly according to claim 1, wherein the fastening means comprise threaded rods attached to the lower frame F1, which extend through holes in the sheet and holes in the upper frame F2, and screw nuts screwed onto the threaded rods so as to press the upper frame F2 and the sheet onto the lower frame F1.

4. The lid assembly according to claim 1, wherein the lid assembly is flexible such that the lid assembly fits tightly on top of the mouth of the drying container when a pressing force is applied to the lid assembly.

5. The lid assembly according claim 1, wherein the lower frame F1 comprises a rim and the at least one opening in the base area of the lower frame F1 is formed as a single opening enclosed by the rim, or a plurality of openings, the rim enclosing the plurality of openings, or a plurality of holes, wherein the rim is free of holes.

6. The lid assembly according to claim 1, wherein the at least one opening in the base area of the upper frame F2 is formed as a single opening enclosed by the rim, or a plurality of openings, the rim enclosing the plurality of openings.

7. The lid assembly according to claim 1, wherein the lower frame F1 and/or the upper frame F2 is/are made from a metal.

8. The lid assembly according to claim 1, wherein the sheet is selected from a) a microporous membrane, b) a nonporous, moisture permeable film, and c) a filter paper.

9. The lid assembly according to claim 1, wherein the sheet is arranged such that the edges are folded back to form a double layer of the sheet within the circumferential channel.

10. The lid assembly according to claim 1, wherein the lid assembly further comprises at least one port, the port being a mobile port having a port opening in the lower frame F1 and/or a port opening in the upper frame F2, the port openings being aligned and covered by the sheet prior to the use of the port or a fixed port having a port opening in the lower frame F1 and/or a port opening in the upper frame F2, and an opening in the sheet, the port openings and the opening in the sheet being aligned and surrounded by a connector arranged on the lower frame F1 or the upper frame F2.

11. A drying container, comprising:

a container body having a bottom and at least one side wall, the at least one side wall defining a mouth of the container body, the mouth having a contact surface enclosing the mouth, and a lid assembly according to claim 1, wherein the contact surface engages the circumferential channel of the lid assembly.

12. The drying container according to claim 11, the drying container further comprising one or more fastening means to reversibly attach the container body to the lid assembly.

13. The drying container according to claim 12, wherein the fastening means are selected from clamps, screws, and magnetic fastening means.

14. The drying container according to claim 11, wherein the container body is made from a metal.

15. A method for drying of material, comprising the following steps:

a) introducing the material to be dried into a container body, b) closing the container body by a lid assembly, and c) exposing the closed drying container to conditions suitable to effect drying, wherein steps a) and b) can be carried out in any order, wherein the lid assembly comprises:

a lower frame F1, an upper frame F2, a vapor permeable sheet positioned between the two frames, and fastening means, wherein the lower frame F1 and the upper frame F2 are each shaped as an open box having a base area and at least one side wall, the lower frame F1 and upper frame F2 being arranged such that a circumferential channel is formed, an outer side wall of the channel being formed by the at least one side wall of the upper frame F2, an inner side wall of the channel being formed by the at least one side wall of the lower frame F1 and a top wall of the channel being formed by a rim of the upper frame F2, wherein a width of the channel is chosen such that a mouth of a container body of a drying container can engage in the channel, the lower frame F1 and the upper frame F2 each comprise at least one opening in the respective base areas of F1 and F2, wherein the at least one opening in the lower frame F1 at least partially overlaps with the at least one opening in the upper frame F2, the sheet covers the at least one opening in the lower frame F1 and the sheet further covers at least a part of the top wall of the channel, and the lower frame F1, the sheet, and the upper frame F2 are aligned and held together by the fastening means, the fastening means providing a releasable connection between the lower frame F1 and the upper frame F2.

16. The method of claim 15, wherein the drying is freeze-drying.

* * * * *